US007669742B2

(12) United States Patent
Rush

(10) Patent No.: US 7,669,742 B2
(45) Date of Patent: Mar. 2, 2010

(54) SYSTEMS FOR SAFE CARRIAGE AND DEPLOYMENT OF HAND-HELD NON-LETHAL/LETHAL DEPLOYABLE DEVICES

(76) Inventor: Derek Rush, 6031 Winged Foot Dr., Gilroy, CA (US) 95020

( * ) Notice: Subject to any disclaimer, the term of this patent is extended or adjusted under 35 U.S.C. 154(b) by 1010 days.

(21) Appl. No.: 11/219,470

(22) Filed: Sep. 1, 2005

(65) Prior Publication Data

US 2006/0208019 A1 Sep. 21, 2006

Related U.S. Application Data

(60) Provisional application No. 60/606,609, filed on Sep. 2, 2004.

(51) Int. Cl.

| | |
|---|---|
| ***A45F 3/16*** | (2006.01) |
| ***A45F 5/00*** | (2006.01) |
| ***A45F 3/18*** | (2006.01) |
| ***B44D 3/14*** | (2006.01) |

(52) U.S. Cl. ..... 224/148.7; 248/311.2; 248/309.1; 248/682; 248/312; 248/316.1; 248/316.7; 224/425; 224/661; 224/684; 224/914; 102/336; 102/368; 102/343; 102/358; 102/361; 102/502

(58) Field of Classification Search ..... 248/311.2, 248/309.1, 682, 312, 316.1, 316.7; 224/148.7, 224/425, 661, 684, 914; 102/336, 368, 343, 102/358, 361, 502

See application file for complete search history.

(56) References Cited

U.S. PATENT DOCUMENTS

| | | | | | |
|---|---|---|---|---|---|
| 2,195,826 | A | * | 4/1940 | Roessner | 169/26 |
| 2,532,244 | A | * | 11/1950 | William | 220/278 |
| 2,670,886 | A | * | 3/1954 | Walton | 224/247 |
| 2,797,034 | A | * | 6/1957 | Blackman | 224/603 |
| 3,224,644 | A | * | 12/1965 | Davis | 222/162 |
| 3,565,384 | A | * | 2/1971 | Lockwood | 248/312 |
| 3,719,305 | A | * | 3/1973 | Pressnell | 220/740 |
| 3,762,330 | A | * | 10/1973 | Hall | 102/487 |
| 4,588,116 | A | * | 5/1986 | Litman | 224/672 |
| 4,606,523 | A | * | 8/1986 | Statz et al. | 248/311.2 |
| 4,615,476 | A | * | 10/1986 | Hobbs et al. | 222/153.09 |
| 4,708,273 | A | * | 11/1987 | Grant | 224/148.6 |
| 4,749,112 | A | * | 6/1988 | Harper | 224/553 |
| 4,997,157 | A | * | 3/1991 | Sweeny | 248/313 |
| 5,013,074 | A | * | 5/1991 | Galle | 294/33 |

(Continued)

*Primary Examiner*—J. Allen Shriver, II
*Assistant Examiner*—Nkeisha J Smith
(74) *Attorney, Agent, or Firm*—Courtney Staniford & Gregory LLP

(57) ABSTRACT

A tactical device holster (TDH) system is described that is a complete carry and deployment solution allowing for split-second deployment of hand-held non-lethal/lethal deployable devices (HNLDD) by tactical personnel. The TDH system allows tactical personnel to deploy HNLDDs without having to disarm because deployment requires only a single hand, and the TDH system indexes the HNLDD in the proper position for deployment. The TDH system allows the HNLDD to go from secure carry to deployment in under one second while not impeding the deadly force option during deployment. The TDH system keeps the fuze lever of the HNLDD fixed in a pre-specified position. The HNLDD is not altered for use with the TDH system and allows quick insertion of the HNLDD. The TDH system supports numerous HNLDDs and tactical pyrotechnic and incendiary devices, and can be fixed to various tactical clothing, vests, holsters, equipment, and vehicle components.

8 Claims, 10 Drawing Sheets

U.S. PATENT DOCUMENTS 5,071,100 A * 12/1991 Sweeny ..... 248/313
5,085,147 A * 2/1992 Gold et al. ..... 102/486
5,205,730 A * 4/1993 Capdeville ..... 431/320
5,232,137 A * 8/1993 Devine ..... 224/666
5,302,302 A * 4/1994 Shelley et al. ..... 224/148.4
5,361,950 A * 11/1994 Signal et al. ..... 224/585
5,362,022 A * 11/1994 McLoughlin et al. ..... 248/313
5,531,359 A * 7/1996 Winner ..... 222/153.11
5,609,283 A * 3/1997 Harrison, Jr. ..... 224/678
5,654,523 A * 8/1997 Brunn ..... 102/498
5,724,707 A * 3/1998 Kirk et al. ..... 24/3.7
5,765,738 A * 6/1998 Hoffner ..... 224/661
5,944,238 A * 8/1999 Stark ..... 224/148.4
6,145,169 A * 11/2000 Terzuola et al. ..... 24/170
6,220,557 B1 * 4/2001 Ziaylek et al. ..... 248/316.1
6,547,118 B2 * 4/2003 Beletsky et al. ..... 224/661
6,557,738 B1 * 5/2003 Meintzer ..... 224/148.7
6,763,965 B2 * 7/2004 Parenteau ..... 220/263
6,766,912 B1 * 7/2004 Gibbs ..... 211/74
6,932,255 B2 * 8/2005 Van Houtte ..... 224/414
7,156,269 B1 * 1/2007 Meyer et al. ..... 222/568
7,156,353 B2 * 1/2007 Kringel et al. ..... 248/311.2
7,207,538 B2 * 4/2007 Kent-Fawkes ..... 248/311.2
7,216,721 B2 * 5/2007 Jacobson et al. ..... 169/30
7,275,729 B2 * 10/2007 Sherman et al. ..... 248/311.2
D562,116 S * 2/2008 Ziaylek et al. ..... D8/373
2007/0039989 A1 * 2/2007 Nistico ..... 224/674
2007/0210227 A1 * 9/2007 Krall ..... 248/311.2
2007/0210228 A1 * 9/2007 Brenner et al. ..... 248/311.2
2008/0061098 A1 * 3/2008 Hoffner ..... 224/661

* cited by examiner

SYSTEMS FOR SAFE CARRIAGE AND DEPLOYMENT OF HAND-HELD NON-LETHAL/LETHAL DEPLOYABLE DEVICES

RELATED APPLICATION

This application claims the benefit of U.S. Patent Application No. 60/606,609, filed Sep. 2, 2004.

TECHNICAL FIELD

The disclosure herein relates generally to carriage and deployment of tactical devices. In particular, this disclosure relates to devices for the safe and efficient carriage and deployment of hand-held non-lethal/lethal deployable devices by tactical personnel.

BACKGROUND

Tactical personnel including law enforcement and military personnel have come to rely on hand-held non-lethal/lethal deployable devices (also referred to herein as "HNLDDs") during missions such as those involving armed offenders, hostage situations, riot situations, and high-risk warrants. When used, HNLDDs emit a blaring noise usually accompanied by a temporarily blinding flash of light which surprises or stuns the intended suspects, thereby allowing their safe apprehension. The HNLDDs are usually thrown through a window or door of a crime location, such as a room in a house, to temporarily distract the occupants for a time sufficient to enable the law enforcement personnel to safely enter the location and obtain custody of the suspects. When used properly, these devices provide a significant tactical advantage in temporarily neutralizing and disorienting suspects near an initiated device while reducing the possibility of injury to tactical personnel, hostages, and suspects.

The HNLDDs are also known as one or more of diversionary devices, Noise Flash Diversionary Devices (NFDD), light-sound devices, flash/sound devices, flash/sound diversionary devices, flashbangs, distraction devices, stun and distraction devices, grenades, and sound and flash grenades to name a few. They typically include a canister, a powder charge housed inside the canister, and a fuze assembly. The fuze assembly has a number of components including a fuze lever or safety lever (also referred to as a "spoon"), a striker, a primer, a pull ring and safety pin that are clipped together, a delay element, and an ignition mixture. When used properly, upon deflagration, an HNLDD creates a loud report and a brilliant light that may disorient and confuse those who are inside the tactical environment.

Types of HNLDDs generate bright light and heat as a result of initiation of the powder charge. The flash of light, which can be at least in the range of two million to eight million candela, is bright enough to cause temporary loss of night vision even with the eyelids closed. Initiation of the HNLDD also produces a loud noise typically at least in the 170-185 decibel (dB) range (can be significantly more in military applications), which can cause injury to unprotected hearing. The HNLDDs when deflagrated also generate smoke by the rapid burning of the powder charge, which may obscure targets inside a deployment location. Furthermore, when deflagrated, the HNLDDs create a blast wave as a result of the change in atmospheric pressure that the device generates (referred to as "overpressure").

The deflagration of an HNLDD therefore produces disorienting physiological and psychological effects for those in close proximity to the device. Consequently, when used as intended by properly trained personnel, the HNLDD reduces the risk of death and serious injury for the personnel deploying the device as well as others in the deployment area.

The dangerous effects of the HNLDD make controlled deployment of the device essential. The typical HNLDD however, with a fuze assembly that includes a canister, a spoon, and a pull ring and safety pin, requires the use of two hands during deployment. This is further complicated by the fact that the devices are typically carried by tactical personnel in pouches much like munitions or other accessory pouches. One example of a carry pouch is the Flashbang Pouch available from Blackwater Gear™ of Oregon City, OR, which holds one flashbang device on a duty belt (another example of a carry pouch is the Duty Single Flash Bang Pouch, available from Blackhawk Industries, Inc. of Norfolk, Virginia (Blackhawk)). The Flash Bang Pouch also may be used in combination with other munition carry devices, for example, the Omega® Shot Shell (10) Flashbang (2) Pouch, available from Blackhawk, which is configured to hold two flashbangs in each of two flash bang pouches along with ten shot shells in a single pull down pouch. Therefore, an individual deploying an HNLDD most use both hands to unbuckle the carry pouch, and is required to deploy the device by pulling the HNLDD from the pouch by the fuze head. As handling of HNLDDs by the fuze head is not recommended by manufacturers of HNLDDs, deployment of HNLDDs from typical carry pouches is inherently unsafe because it requires handling the device in a manner not recommended by HNLDD manufacturers.

The danger inherent in deployment of HNLDDs from conventional carry pouches is further increased for tactical personnel like law enforcement and military personnel that are frequently in situations where they only have one hand available for use during situations in which they must deploy HNLDDs. One example of a tactical deployment situation involves law enforcement personnel that must control a weapon or other tactical equipment (e.g., radio, flash light, etc.) with one hand while deploying an HNLDD with the other hand. As a result, the law enforcement officer is faced with a choice of not using the HNLDD or being forced to re-holster or otherwise safe a deployed weapon in order to use the HNLDD. Consequently, there is a need for a device or system that allows for single-hand deployment of HNLDDs.

Improper handling of an HNLDD can result in traumatic injuries when the device makes direct contact with a human (e.g., personnel deploying the device, suspect, etc.) at the moment of deflagration. Improper handling of the device often results from improper handling of the HNLDD by an operator preparing to deploy the device. Examples of improper handling include improper placement of the device in the hand of the deploying personnel at the moment deployment is initiated, improper control of the spoon of an unpinned device by partially opening and closing the hand and/or passing the device from one hand to another, and trying to re-pin a device that was previously readied for deployment and then not deployed.

Improper handling can result, for example, when an operator attempts deployment of an HNLDD while also handling a weapon with one hand. In addition to managing a weapon, tactical personnel must be cognizant of the deployment area because the landing area of an HNLDD may contain objects like broken glass, gravel, and/or nails that are turned into projectiles by deflagration of the HNLDD. Further, the deployment area may include carpet, paper, dry grass, and/or drugs or drug byproducts that increase the probability of secondary fire or explosion as a result of HNLDD deflagration. The tactical personnel must also be aware of innocent people in the deployment area that could be injured by the HNLDD. This high level of awareness in the deployment area required of the tactical personnel further increases the chances for mishandling of an HNLDD during deployment. Consequently, there is a need to reduce or eliminate improper deployment and handling of HNLDDs because it is desirable that these devices be carried and deployed in a manner that is safe for use by tactical personnel and which causes minimal or no permanent damage to the persons against whom the devices are used or who are otherwise in/near a deployment area.

INCORPORATION BY REFERENCE

Each publication, patent, and/or patent application mentioned in this specification is herein incorporated by reference in its entirety to the same extent as if each individual publication or patent application was specifically and individually indicated to be incorporated by reference.

Figure 1:
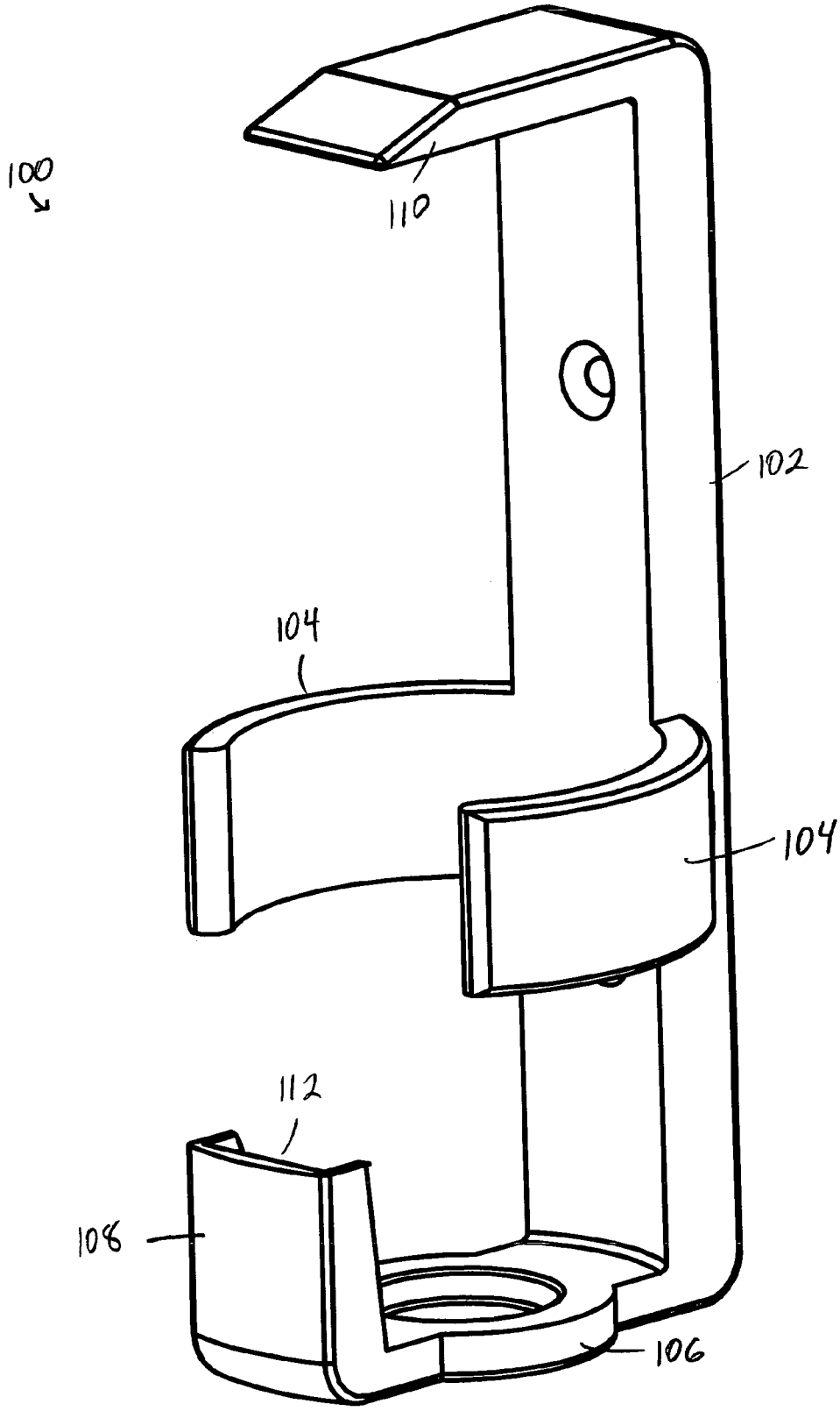
FIG. 1 is a front perspective view of a tactical device holster (TDH), under an embodiment.

In the drawings, the same reference numbers identify identical or substantially similar elements or acts. To easily identify the discussion of any particular element or act, the most significant digit or digits in a reference number refer to the Figure number in which that element is first introduced (e.g., element 100 is first introduced and discussed with respect to FIG. 1).

DETAILED DESCRIPTION

A holster is described herein for the carry and deployment of HNLDDs and other hand-deployed tactical devices. The HNLDD holster, referred to herein as the "tactical device holster" or "TDH," is a complete carry and deployment solution that allows for split-second deployment of HNLDDs by tactical personnel. The TDH is configured to allow tactical personnel to deploy the devices without having to disarm because deployment requires only a single hand, and the TDH indexes the HNLDD in the proper indexed position for safe deployment. The TDH thus allows the HNLDD to go from secure carry to deployment in under one second while not impeding use of the deadly force option during the deployment.

The TDH of an embodiment supports the safe carriage of HNLDDs in any tactical environment because the TDH keeps the body and fuze lever (alternatively referred to as a "safety lever" or a "fuse lever") of the HNLDD fixed in a position. The TDH requires no altering of the HNLDD and allows the HNLDD to be inserted into the TDH in seconds. The TDH can be fixed to a variety of tactical clothing, vests, holsters, equipment, and vehicles or vehicle components to name a few. The TDH of an embodiment supports numerous types of HNLDDs as well as other tactical pyrotechnic or incendiary grenades or devices. The TDH has been effective in use in tactical operations by a Special Weapons And Tactics (SWAT) unit of a police department in California.

In the following description, numerous specific details are introduced to provide a thorough understanding of, and enabling description for, embodiments of the TDH. One skilled in the relevant art, however, will recognize that these embodiments can be practiced without one or more of the specific details, or with other components, systems, etc. In other instances, well-known structures or operations are not shown, or are not described in detail, to avoid obscuring aspects of the disclosed embodiments.

Figure 2:
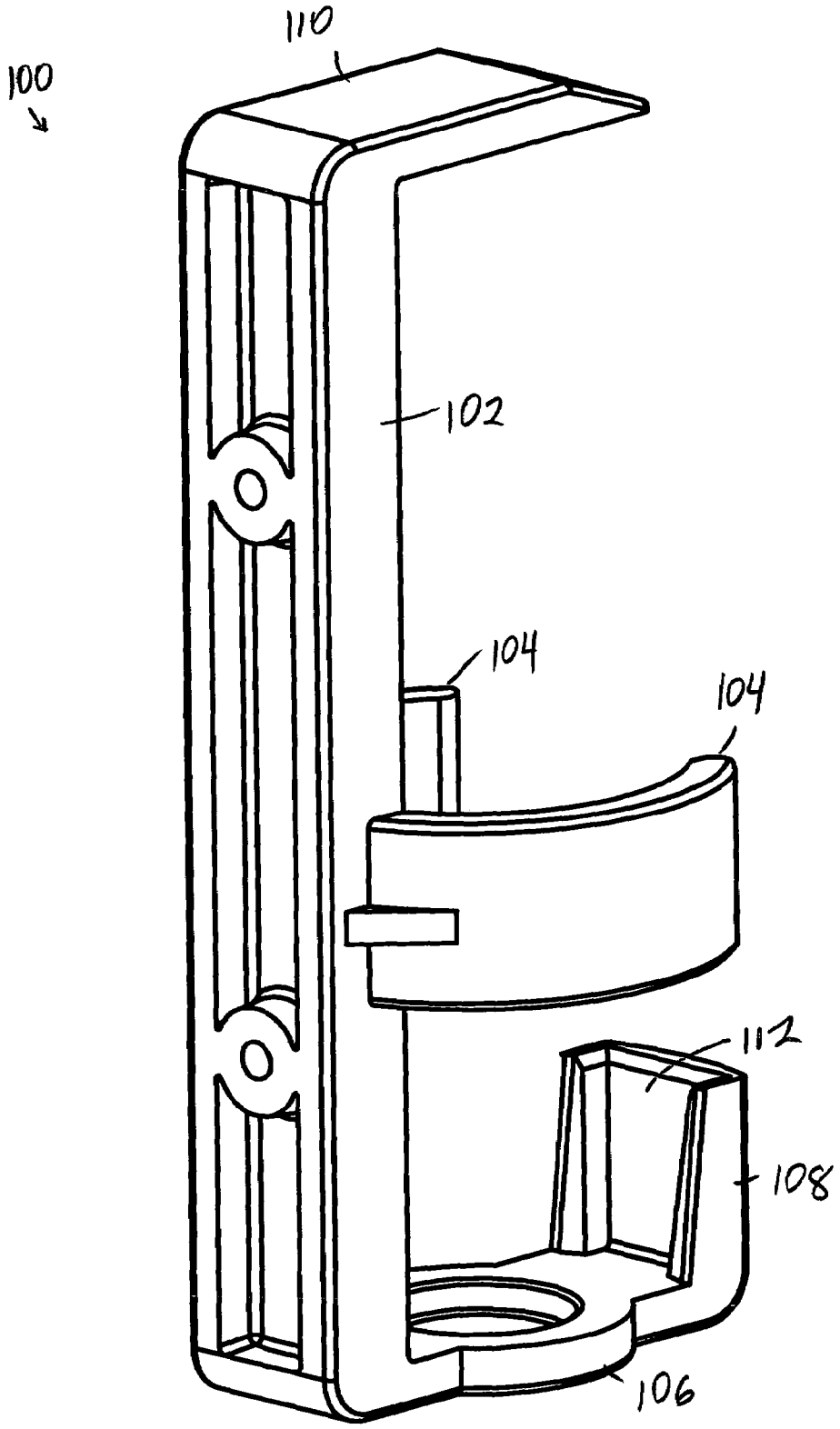
FIG. 2 is a rear perspective view of the TDH, under an embodiment.

FIG. 1 is a front perspective view of the tactical device holster (TDH) 100, under an embodiment. FIG. 2 is a rear perspective view of the TDH 100, under an embodiment. The TDH includes a vertical member 102, lateral supports 104, a platform 106, an indexing device 108, and a restricter 110 as described in detail below. The vertical member 102 is coupled or connected to a number of lateral supports 104. The TDH 100 of an embodiment includes two lateral supports 104, but is not so limited as alternative embodiments may include any number of lateral supports as appropriate to the HNLDD intended for carry. The lateral supports 104 are configured to form a semi-circular cavity that receives and supports a housing of an HNLDD (not shown). The lateral supports of alternative embodiments may be configured to form a cavity having a shape (e.g., spherical, round, rectangular, etc.) appropriate to the HNLDD intended for carry.

The platform 106 is coupled or connected to a lower region of the vertical member 102, and the platform 106 is configured to support a base of the HNLDD housing. The indexing device 108 of an embodiment is coupled or connected to at least one end region of the platform 106. The indexing device 108 includes a recess 112 or recessed region 112 configured to secure a fuze lever of the HNLDD and index the HNLDD in a pre-specified position.

The restricter 110 of an embodiment is coupled or connected to an upper region of the vertical member 102, and the restricter 110 is configured to secure the fuze lever of the HNLDD. Similar to the indexing device 108, the restricter 110 can include a recess or recessed region (not shown) on an inward facing portion or area of the restricter 110. The recess is configured to secure a portion of the fuze lever or other portion of the fuze assembly. Alternative embodiments may not include the restricter 110.

The TDH 100 can be formed as a single piece that includes the vertical member 102, lateral supports 104, platform 106, indexing device 108, and/or restricter 110. Furthermore, the TDH 100 of alternative embodiments can be formed in any number of pieces as appropriate to a manufacturing process and/or assembly process of the TDH 100. The TDH 100 comprising a number of pieces may include, for example, three pieces or components assembled on a rail-type or other mounting system so as to support multiple configurations of the TDH 100 and thereby supporting different HNLDD types of different manufacturers.

The TDH 100 of an embodiment can be formed from any of a variety of materials that provide a lightweight yet strong device. The TDH 100 of an embodiment can comprise a material like plastic, polymer, nylon, fiberglass, and/or alloy but is not so limited.

The TDH accepts HNLDDs that include one or more of diversionary devices, Noise Flash Diversionary Devices (NFDD), light-sound devices, flash/sound devices, flash/sound diversionary devices, flashbangs, flash-bang stingballs, distraction devices, grenades, gas grenades, smoke grenades, frangible grenades, percussion grenades, stun grenades, stun and distraction devices, and sound and flash grenades. For example, the HNLDD can include devices manufactured by one or more of NICO Pyrotechnik (e.g., Sound & Flash 1-Bang, 2-Bang, 6-Bang, 7-Bang, 9-Bang, etc.), Combined Tactical Systems, Inc. (e.g., 7290, 7290M), ALS Technologies (e.g., ALS09), Defense Technologies (e.g., 7001 SC, Omni Blast 100, Def-Tec #25), Precision Ordnance (e.g., DD400 Mag Load, T429), and Pyrotechnic Specialties (e.g., MK 141 Mod 0) to name a few. While a particular configuration of the components of the TDH 100 are shown and described herein, the TDH 100 is not limited to this configuration of vertical member, lateral supports, platform, indexing device, and restricter as different configurations may be used to support HNLDDs of different manufacturers or different types and/or other hand-held deployed tactical devices.

Figure 3:
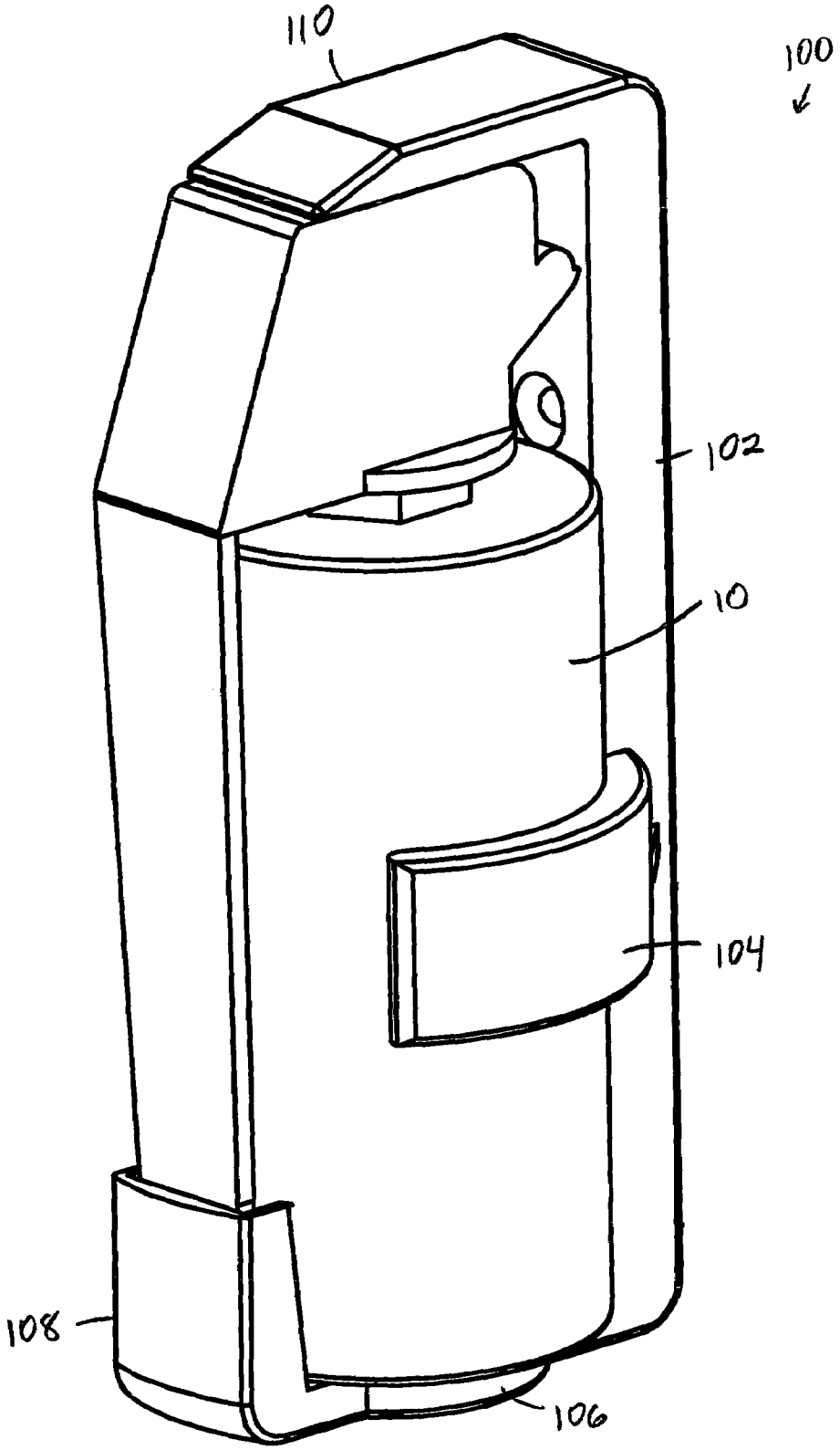
FIG. 3 is a front perspective view of the TDH securing a hand-held non-lethal/lethal deployable device (HNLDD), under an embodiment.

FIG. 3 is a front perspective view of the TDH 100 securing an HNLDD 10, under an embodiment. The TDH 100, as described herein, is configured to secure the HNLDD 10 in a pre-specified position using the lateral supports 104, platform 106, indexing device 108, and/or restricter 110 in some combination. The TDH of an embodiment can include a contoured area or material (e.g., rubber, silicon, etc.) (not shown) in at least a portion of the vertical member 102 between the vertical member 102. and the HNLDD 10; this contoured area or material may be permanently affixed to the vertical member 102 or, alternatively, removeably coupled to the vertical member 102.Alternatively, the contoured area may be a permanent part of the vertical member The contoured area restricts placement of the HNLDD 10 in the TDH 100 to that HNLDD 10 for which the TDH 100 is configured. The contoured area also ensures proper placement and indexing of the HNLDD 10 in the TDH 100 and reduces or eliminates movement (e.g., rotation) of the HNLDD 10 in the TDH 100 thereby preventing inadvertent misplacement of the HNLDD 10 in the TDH 100. The contoured area also reduces or eliminates dislodging of the HNLDD 10 by a foreign object.

Figure 4:
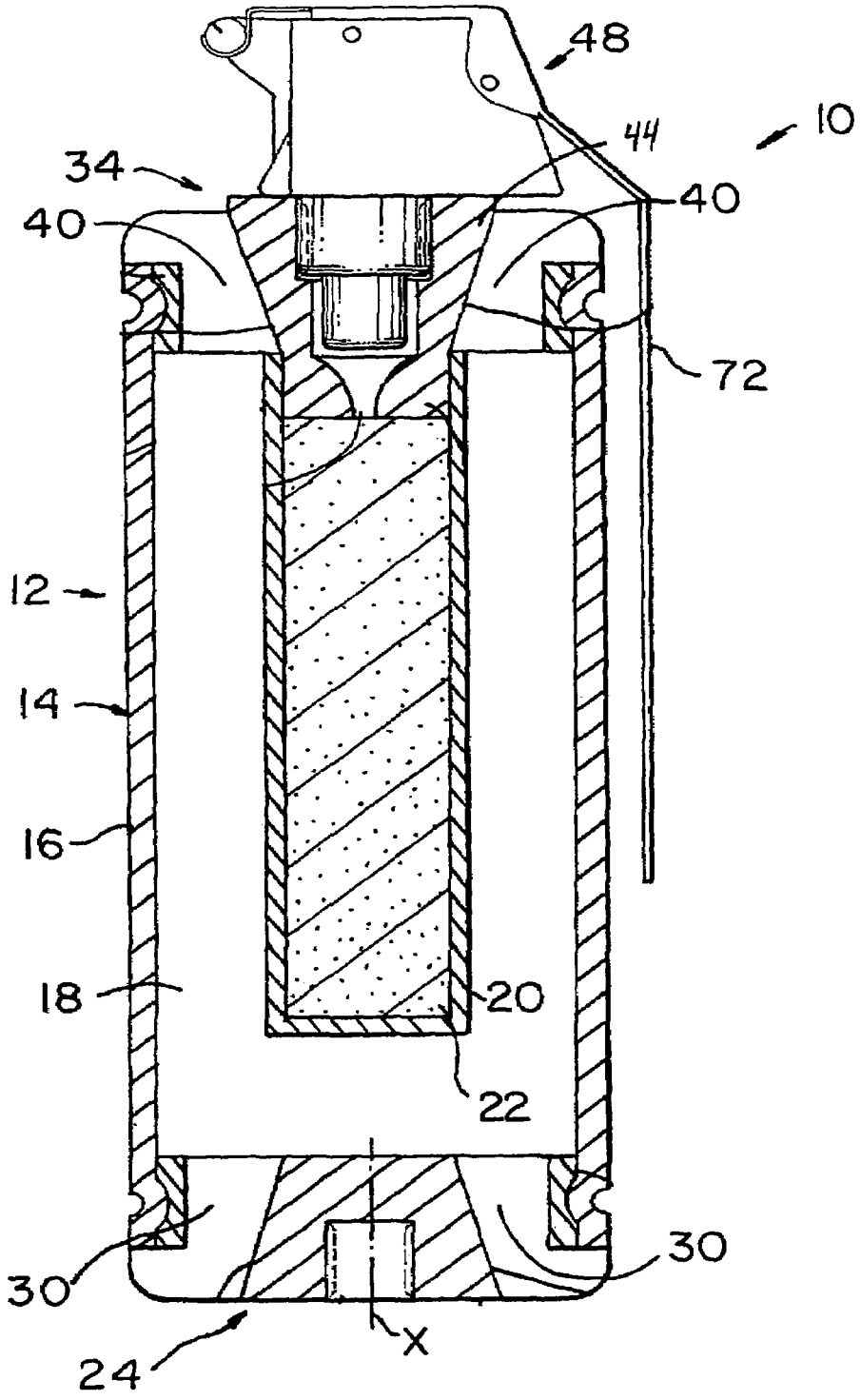
FIG. 4 shows an example HNLDD for carry and deployment from the TDH, under an embodiment.

FIG. 4 shows an example HNLDD 10 for carry and deployment from the TDH 100, under an embodiment. The HNLDD 10 of this example is a NFDD 10 that has a longitudinal axis x and includes a housing 12 having an elongate hollow cylindrical body 14. An NFDD 10 similar to the one of this example is described in detail in U.S. Pat. No. 5,654,523. The housing 12 of the NFDD 10 is cylindrically shaped and made of a material like steel, for example grade 1020 standard mechanical tubing. The cylindrical body includes a side wall 16 that defines a cylindrical cavity 18 configured for receiving a cartridge 20 containing an explosive charge 22. The housing 12 includes a bottom end section or base 24; while the base 24 is shown as a separate member secured to the body 14, the base 24 may be integrally formed with body 14 or otherwise secured to the body 24. A number of vents or slots 30 are formed in the base 24 for communicating cavity 18 with the environment. The vents 30 provide a path for releasing explosive energy generated upon detonation of the explosive charge 22 from the cavity 18 to the area around the NFDD 10. The vents 30 may be in various portions of the NFDD depending on the type and/or manufacturer of the NFDD.

The NFDD 10 also includes a top end section or cover 34 positioned at the top of body 14. The cover 34 is configured as a combination fuze (alternatively referred to as a "fuse") and port block wherein a center portion 44 of the cover 34 defines a central elongated opening configured for receiving a fuze 48. The cover 34 also includes vents 40 but is not so limited. The upper defining wall of the central elongate opening is threaded for receiving complementary threading on the fuze 48 for securing the fuze 48.

The fuze 48 is comprised of a fuze lever 72 and a fuze pin (not shown) or pin which, for safety reasons, must be removed before the NFDD 10 can be used. The fuze 48 includes the Model 201 fuze with pyrotechnic delay available from CTS, for example, but is not so limited.

To use the NFDD 10, pin is removed and lever 72 is depressed against the body 14. The NFDD 10 is then thrown toward an intended target. Once released, the lever 72 returns to its original position thereby activating fuze 48 which ignites a flash charge after a pre-specified delay (e.g., approximately 0.75 to 2 seconds). When the flash charge is ignited, a deflagration ensues. When the explosion occurs, the resultant energy is released relatively evenly through the vents of the NFDD 10.

The TDH 100 of an embodiment supports the safe carriage of the NFDD 10 in any tactical environment because the TDH 100 keeps the body and fuze lever of the NFDD 10 fixed in a pre-specified position. The TDH 100 is a complete carry and deployment solution that allows for split-second deployment of the NFDD 10 by tactical personnel. The TDH 100 is configured to allow tactical personnel to deploy the NFDD 10 without having to disarm because deployment requires only a single hand, and the TDH 100 indexes the NFDD 10 in the proper position for safe deployment. The TDH 100 thus allows the NFDD 10 to go from secure carry to deployment in under one second while not impeding use of the deadly force option during the deployment.

Figure 5A:
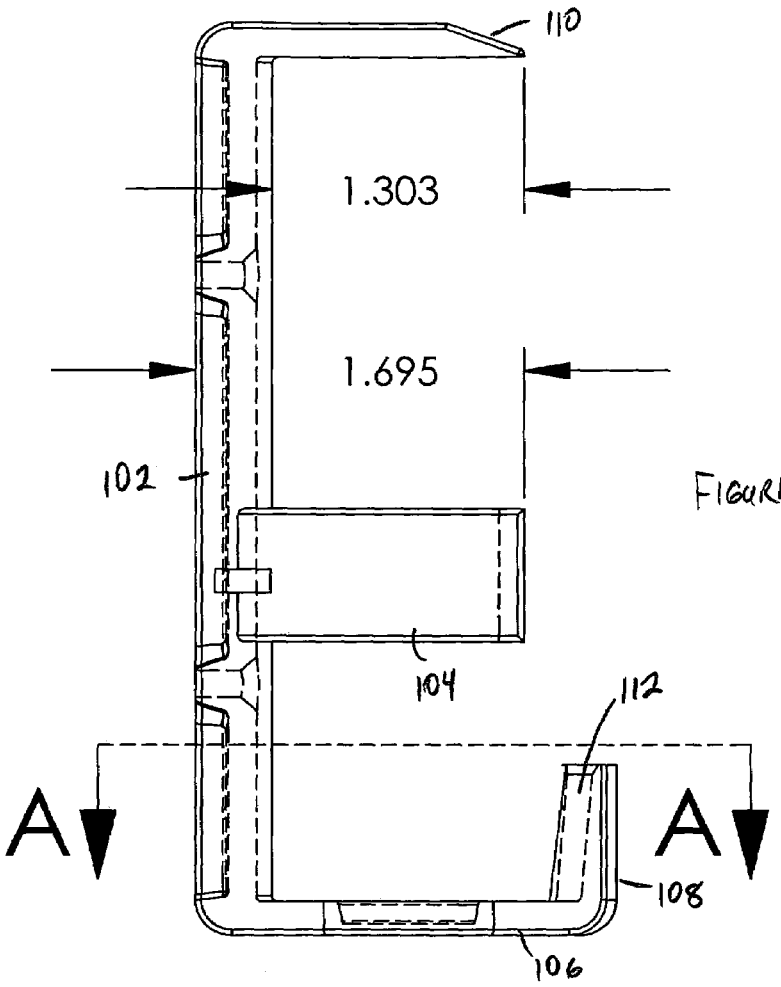
FIG. 5A is a side view of the TDH showing example dimensions, under an embodiment.
Figure 5B:
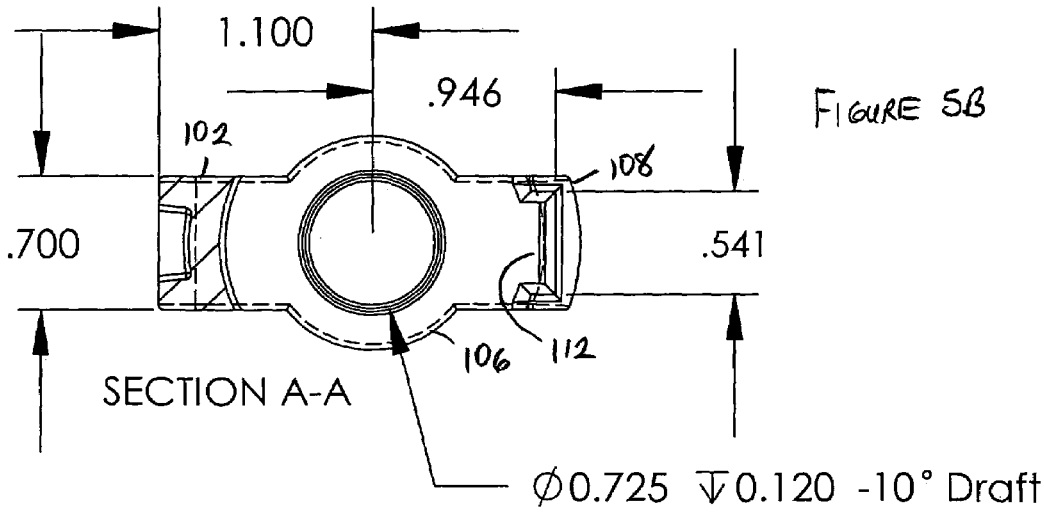
FIG. 5B is a cross-sectional view of the TDH showing example dimensions, under an embodiment.
Figure 5C:
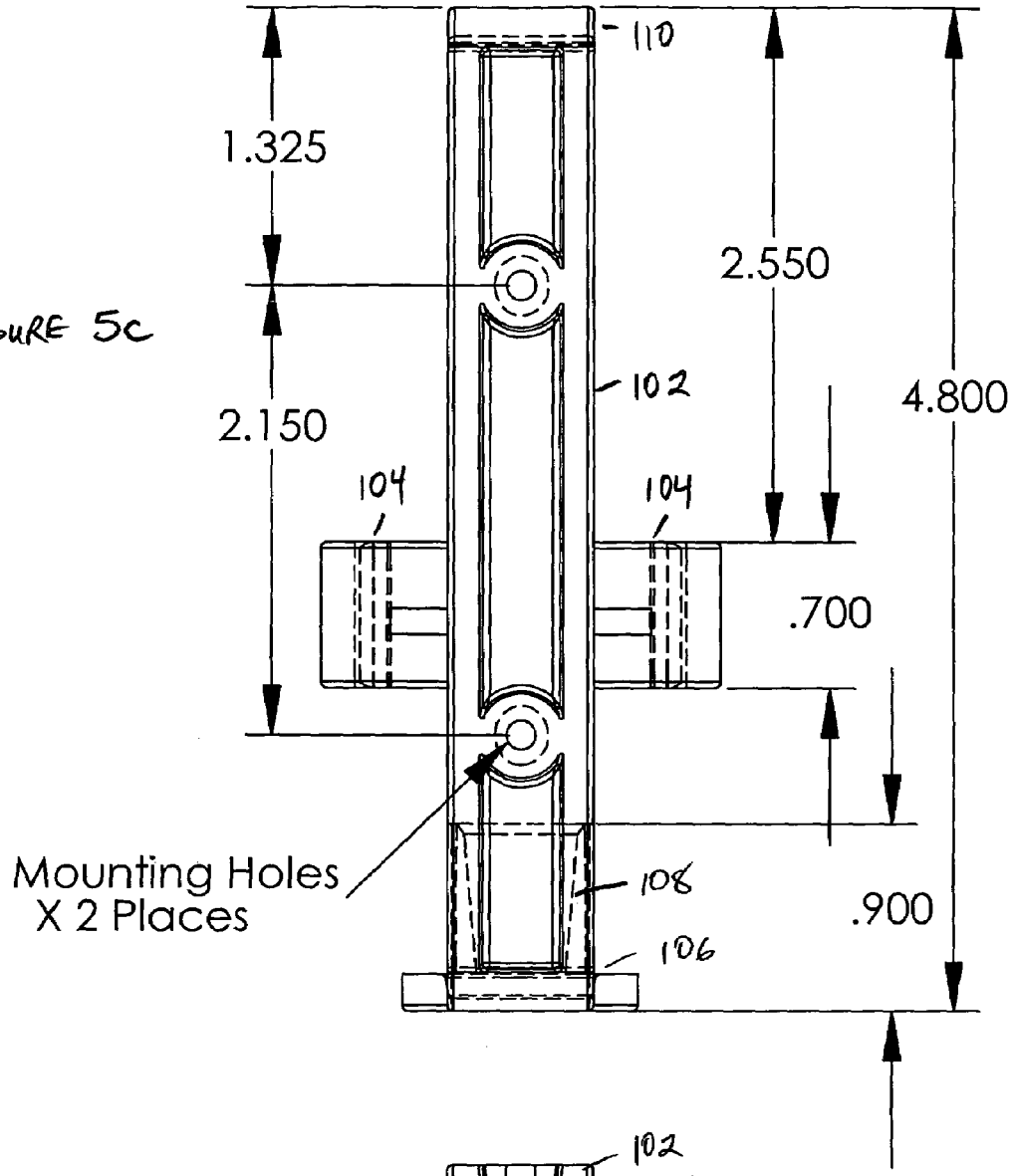
FIG. 5C is a rear view of the TDH showing example dimensions, under an embodiment.
Figure 5D:
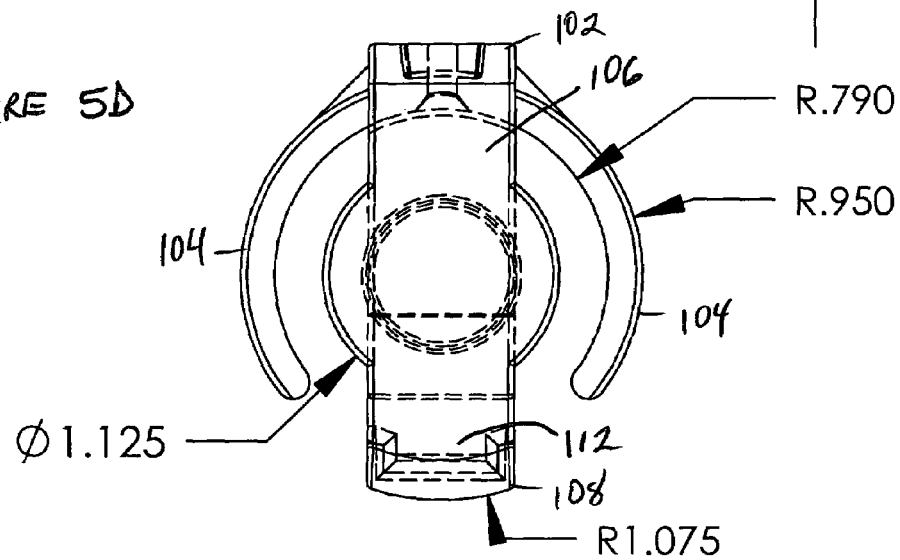
FIG. 5D is a bottom view of the TDH showing example dimensions, under an embodiment.

FIG. 5A is a side view of the TDH 100 showing example dimensions, under an embodiment. FIG. 5B is a cross-sectional view of the TDH 100 showing example dimensions, under an embodiment (the cross-section of FIG. 5B is taken at section A-A shown on FIG. 5A, and provides a view looking down onto a top portion of the platform (i.e., inner portion of the TDH)). FIG. 5C is a rear view of the TDH 100 showing example dimensions, under an embodiment. FIG. 5D is a bottom view of the TDH 100 showing example dimensions, under an embodiment. The dimensions shown, which are in inches, represent an embodiment of the TDH 100; however the TDH of various alternative embodiments may have different dimensions as appropriate to the HNLDD intended for carry/deployment and/or the type of device to which the TDH is secured for carry.

Referring to FIGS. 5A, 5B, 5C, and 5D, a width of the vertical support 102 is approximately 0.700 inches. A front region of the restricter 110 extends approximately 1.303 inches from a rear portion of the vertical support 102. A front region of each lateral support 104 is approximately 1.695 inches from a rear portion of the vertical support 102. The lateral supports 104 are each semi-circular and as such form a region configured to receive a cylindrical housing of an HNLDD. An inside radius of the region defined by the lateral supports 104 is approximately 0.790 inches, and an outside radius of the region defined by the lateral supports 104 is approximately 0.950 inches, where the radii are relative to a center of the platform 106 as defined by the HNLDD intended for carry. A top region of each lateral support 104 is approximately 2.550 inches from a top region of the vertical support 102 or restricter 110, and a width of each lateral support 104 is approximately 0.700 inches.

A center of the platform 106 relative to the HNLDD is approximately 1.100 inches from a rear portion of a lower region of the vertical support 102, and the center is also approximately 0.946 inches from the recess of the indexing device 108. A radius of the platform 106 is approximately 1.075 inches, where the radius is relative to a center of the platform 106 as defined by the HNLDD intended for carry. A top portion of the indexing device 108 extends approximately 0.900 inches from a bottom of the platform 106. A width of the recess 112 of the indexing device 108, which is configured to secure a fuze lever of the HNLDD and index the HNLDD in a pre-specified position, is approximately 0.541 inches. The recess 112 of the indexing device 108 may have a shape (e.g., wedge, rounded, square, etc.) as appropriate to a configuration of the fuze lever it is intended to receive. The indexing device of an alternative embodiment may not include a recessed region.

The TDH 100 of an embodiment can be deployed in operation as mounted to any of a variety of tactical clothing, vests, holsters, equipment, and vehicles or vehicle components to name a few. The combination of the TDH 100 and the component to which the TDH 100 is mounted is referred to herein as the "TDH system" but is not so limited. The vertical support 102 includes a first hole approximately 1.325 inches from a top of the vertical support 102 and a second hole approximately 2.150 inches below the first hole. The first and second holes accept mounting components by which the TDH 100 is mounted to another object as described herein. The vertical support 102 of an alternative embodiment can include any number of holes to accept mounting components (e.g., Picatinny rail, MOLLE, etc.).

The TDH 100 can be deployed through mounting to any tactical component, product and/or equipment. The TDH 100 of an embodiment can generally be mounted to one or more of tactical clothing, vests, holsters, and equipment using a number of fastener equipment or types. The TDH 100 can be mounted directly to other components using screws, screws and posts, rivets, and eyelets to name a few. The TDH 100 can also be mounted to other components using any of a number of intermediary mounting systems or components.

One example for mounting the TDH 100 to other components includes the use of All-purpose, Lightweight, Individual, Carrying Equipment (ALICE) clips. Another example for mounting the TDH 100 includes use of the Modular Lightweight Load-carrying Equipment (MOLLE) system. The TDH 100 can also be mounted to other components using a locking, removeable utility belt clip like the Tek-Lok™, as described further in U.S. Pat. No. 6,145,169. As another example, the TDH 100 can be mounted to other components using a Picatinny rail standardized mount, as described further in Military Standard MIL-STD-1913. Furthermore, the TDH 100 can be mounted to other components using a Weaver rail mount.

Figure 6A:
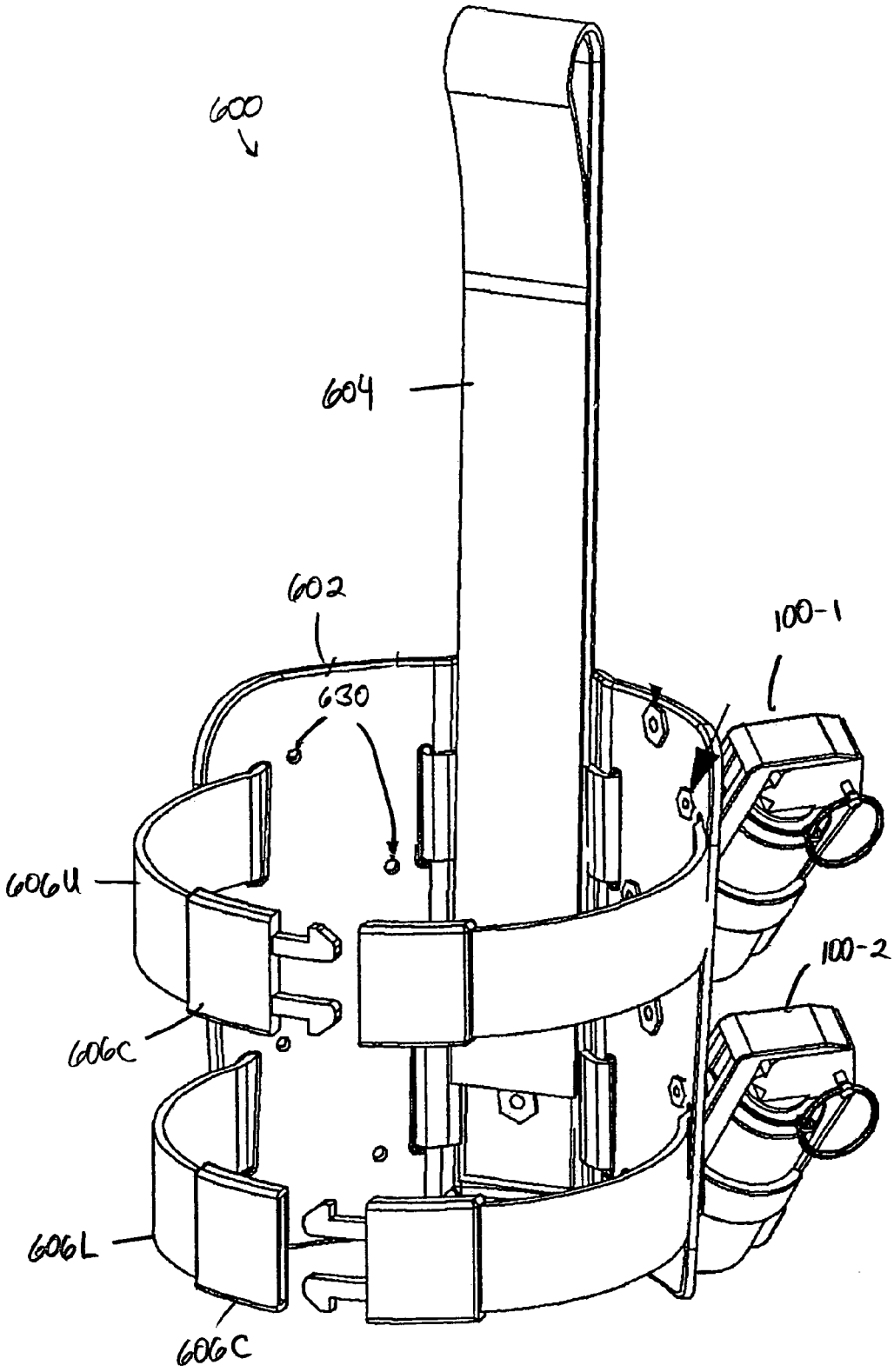
FIG. 6A is a rear perspective view of a TDH system that includes multiple TGHs mounted to a thigh rig, under an embodiment.
Figure 6B:
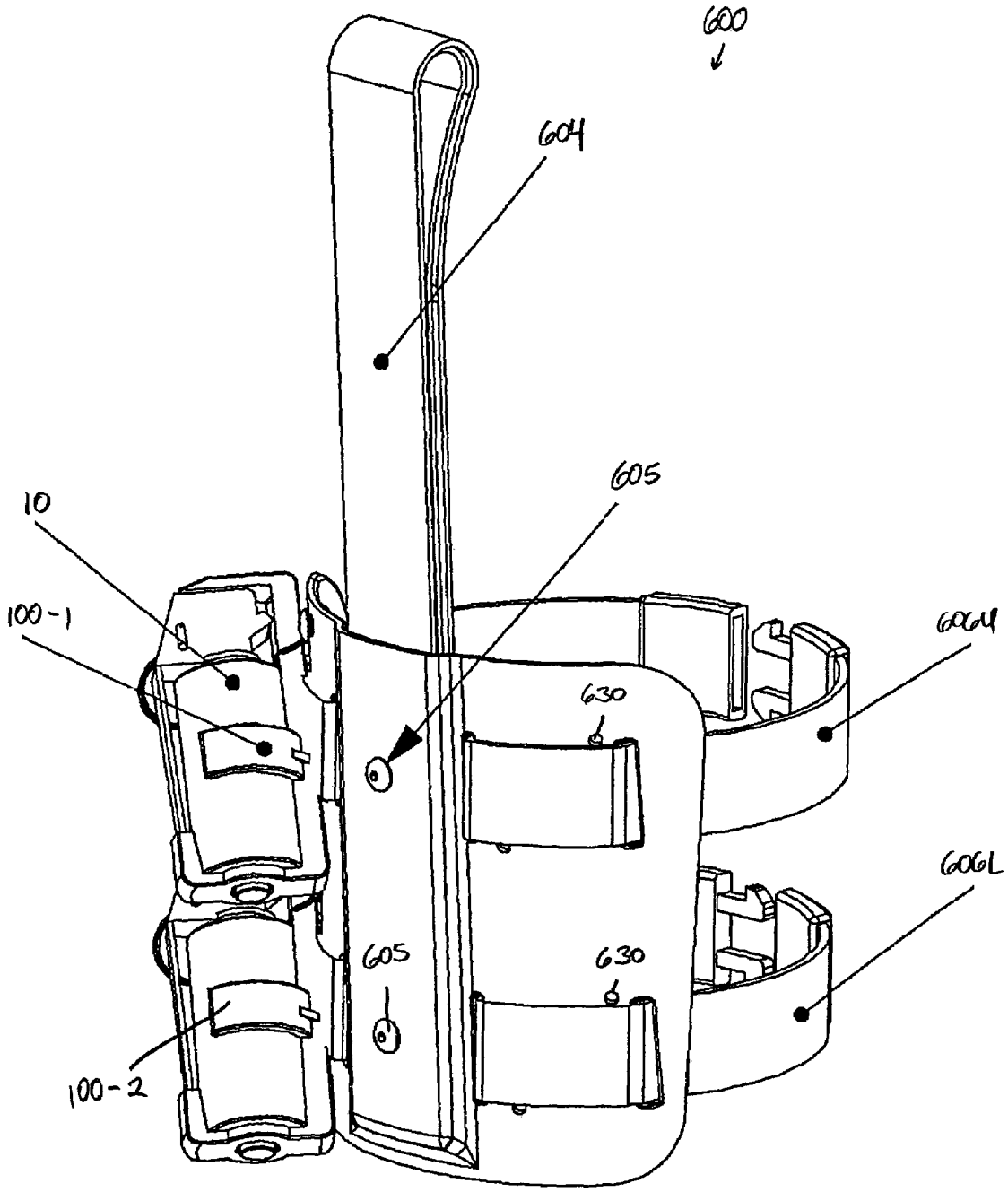
FIG. 6B is a front perspective view of a TDH system that includes multiple TGHs mounted to a thigh rig, under an embodiment.

As one example of the TDH 100 deployed on tactical components or equipment, FIG. 6A and FIG. 6B show rear and front perspective views, respectively, of a TDH system 600 that includes a first TDH 100-1 and second TDH 100-2 mounted to a thigh rig, under an embodiment. The thigh rig includes a thigh guard 602, also referred to as a mounting plate or carrier 602, to which the first TDH 100-1 and second TDH 100-2 are mounted. The thigh guard 602 is mounted to a belt strap 604 using mounting hardware 605 as appropriate to the materials (e.g., screws, rivets, etc.), and the belt strap 604 can have a drop length as appropriate to a wearer. In use the duty belt is routed through the belt strap 604 allowing for wear of the TDH system 600 on the belt of tactical personnel. The TDH system 600 further includes an upper thigh strap 606U and lower thigh strap 606L, and each thigh strap includes a quick-attach clip 606C for quick attachment and release of the TDH system 600 to/from a user's thigh. The TDH system 600 may include other components (not shown) and/or mounting systems (e.g., MOLLE system, webbing to receive ALICE clips, etc.) (not shown) to receive other components as appropriate to particular duty configurations.

The first TDH 100-1 and second TDH 100-2 are mounted to the thigh guard 602, and the mounting uses any combination of fastener types, including but not limited to screws, screws and posts, rivets, and eyelets. The TDH system 600 of this example includes two TGHs 100-1 and 100-2 but is not so limited as alternative embodiments of the TDH system can include any number of TGHs (the thigh pad may include mounting holes 630 to accept additional TGHs or other tactical components). Each TDH 100 can be mounted at an angle relative to a vertical axis of the TDH system 602 in order to correctly index or position the HNLDD for proper deployment.

When preparing to deploy, the fuze lever or safety lever of the fuze assembly should be placed in the user's hand so as to be positioned in line with the web of the hand. Depending upon which hand is used, the device will be in either a fuze up or fuze down orientation. Therefore, in a configuration in which the user wears the TDH system 600 on the thigh that corresponds to the hand with which the HNLDD will be deployed (e.g., user deploying the HNLDD with the right hand wears the TDH system 600 on the thigh of the right leg; right-handed user with a primary weapon (e.g., gun) would wear the TDH system 600 on the left leg so as to handle the primary weapon with the right hand and deploy the HNLDDs with the left hand), the TDH 100-1 and 100-2 of an embodiment is mounted to the thigh guard 602 at an angle of approximately sixty (60) degrees relative to a vertical axis of the TDH system 600. In this configuration the HNLDD carried in the TDH 100-1 and 100-2 will be in a position so that the fuze lever is approximately aligned with the web of the user's hand (the proper holding position) when the hand is in the vicinity of the TDH system 600, and in a fuze-up orientation. The angular orientation of the TDH 100-1 and 100-2 relative to the vertical axis of the TDH system 600 however is configurable as appropriate to individual users.

Figure 7:
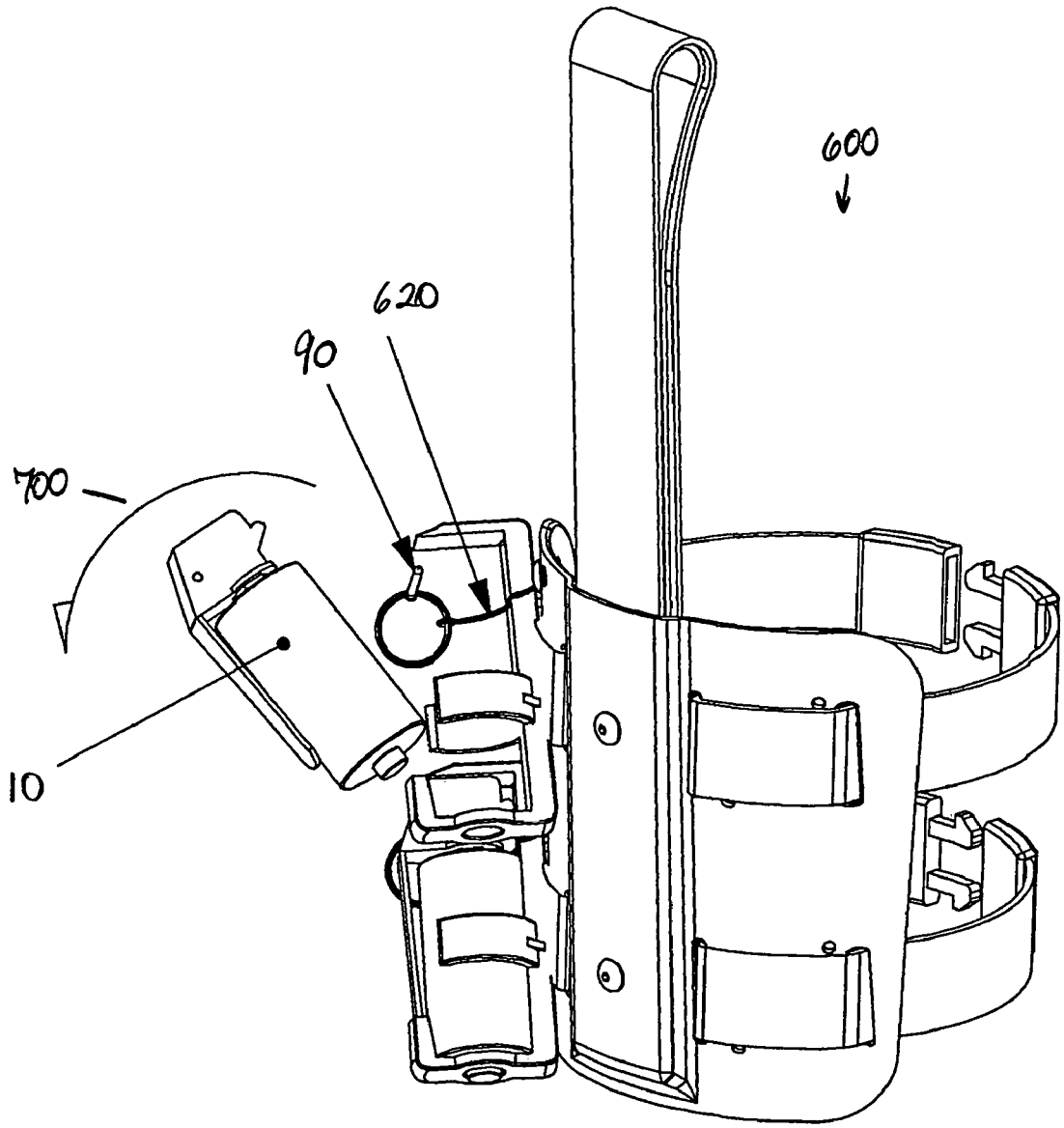
FIG. 7 is a front perspective view of a TDH system that includes a lanyard, under an embodiment.

To assist with one-handed deployment of the HNLDD, the TDH system 600 of an embodiment includes an optional lanyard 620. FIG. 7 is a front perspective view of a TDH system 600 that includes a lanyard 620, under an embodiment. The lanyard 620 couples to the fuze pin 90 on one end and to a fixed component of the TDH system 600 on another end. The lanyard 620 when installed causes the fuze pin 90 of the HNLDD 10 to be pulled from the device 10 simultaneous with or just subsequent to the user pulling 700 the HNLDD 10 from the TDH 100-1 during deployment. The lanyard 620 of an embodiment is approximately 3.5 inches long, and has one end secured to the thigh guard 602 of the TDH system 600. The lanyard 620 comprises metal or other high strength cable in an embodiment, but alternative embodiments may comprise other materials. As an example, the lanyard 620 can be secured to the thigh guard 602 at a position that is approximately 2.25 inches below a top region of the vertical member 102; however, the attachment point for the lanyard 620 can vary according to a configuration of the TDH system 600, a length of the lanyard 620, and/or a planned tactical environment in which the TDH system 600 is to be used.

Figure 8:
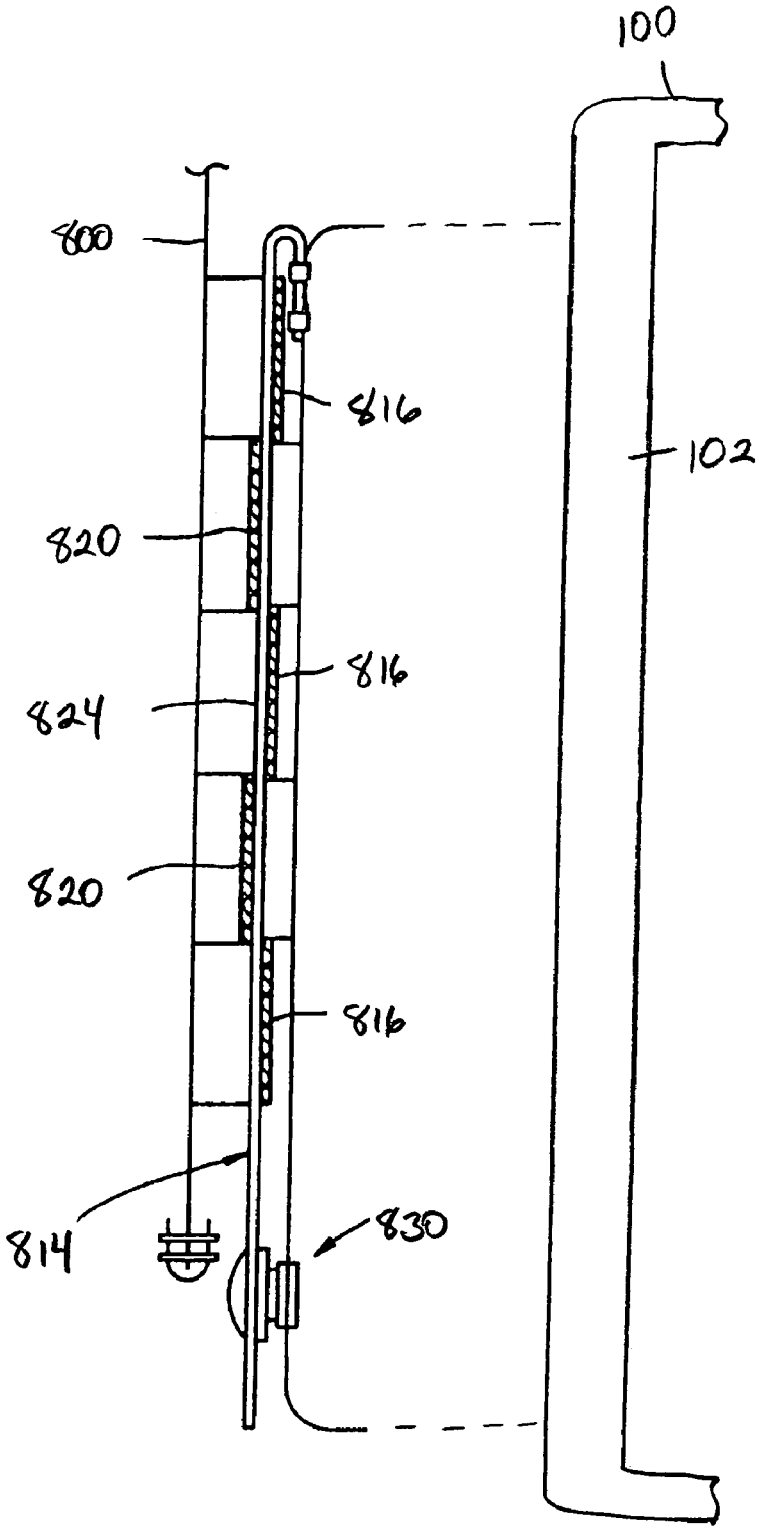
FIG. 8 is a side cross-sectional view of a TDH secured to an object, under an embodiment.

Another example for mounting the TDH 100 includes use of the Modular Lightweight Load-carrying Equipment (MOLLE) system, as described above. The MOLLE system is described in further detail in U.S. Pat. No. 5,724,707. FIG. 8 is a side cross-sectional view of a TDH 100 secured to an object 800, under an embodiment. The object 800 can include but is not limited to belts, vests, thigh rigs, drop leg platforms, and harnesses. The object 800 and the TDH 100 are assembled together by the utilization of the interlock attaching strap system 814 of the MOLLE system. The object 800 has multiple webbings 816 that are attached to the object by stitching. The strips of webbing 816 or any other suitable fabric are generally evenly spaced, and the spacing between the strips of webbing 816 is sufficient to permit the placement of another series of webbings 820. The stitching which holds the strips of webbing 816 in place on the object 800 is perpendicular to the webbing and spaced apart so as to create channels. The channels are of sufficient size to accommodate straps 824 which are attached at one end to the TDH 100 using any suitable and appropriate attaching device. The straps 824 also include a temporary attaching device 830 like Velcro, a tuck, and/or a snap to attach the other end of the strap 824 to the TDH 100.

In operation, the end of the straps 824 are passed in sequence first through a strip of webbing 816 on the object 800 then through the strip of webbing 820 on the TDH 100 and back through the strip of webbing 816 on the object 800 and further back through the strip of webbing 820 on the TDH 100 in an interlocking fashion that enables the TDH 100, which is removeably attached to the object 800, to be attached in a manner that is both easily accomplished and secure. After sequentially interlocking the various webbings 816 and 820, the end of each of the straps 824 is securely fastened to the TDH 100 by the attaching device 830. The interlocking system 814 is effective even if the fastening components 830 become disengaged one from the other because the interlocking of the strap with the strips of webbing provides a relatively secure interlock engaging system that maintains the TDH 100 in an engagement with the object 800.

The TDH system 600 of an embodiment can include an optional cover (not shown) that covers all or a portion of an HNLDD carried in a TDH 100. The cover when used further secures the HNLDD in the TDH 100/TDH system 600 and protects the HNLDD from inadvertent contact with elements of the tactical environment. The cover may comprise ballistic nylon, canvas, and/or other suitable materials. The cover can be secured to the TDH 100 or other components of the TDH system 600 using Velcro or other suitable attaching materials as appropriate to the tactical environment and the configuration of the TDH system 600.

The TDH 100 and/or TDH system 600 as described above can be deployed in operation with or as a component of any of a variety of equipment. This equipment includes but is not limited to duty gear, tactical clothing, vests and/or vest systems in various configurations, holsters and/or holster systems in various configurations, tactical thigh rigs, harnesses, equipment pouches, ammunition/magazine pouches, equipment, assault systems and kits, and vehicles or vehicle components.

Aspects of the TDH and TDH system described herein may be implemented as a component of one or more other tactical systems or tactical equipment as described above. Furthermore, the elements and acts of the various embodiments described above can be combined with one another and/or with other tactical components and equipment known in the tactical arena to provide further embodiments. These and other changes can be made to the TDH and TDH system in light of the above detailed description.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

The above description of illustrated embodiments of the TDH and TDH system is not intended to be exhaustive or to limit the TDH and TDH system to the precise form disclosed. While specific embodiments of, and examples for, the TDH and TDH system are described herein for illustrative purposes, various equivalent modifications are possible within the scope of the TDH and TDH system, as those skilled in the relevant art will recognize. The teachings of the TDH and TDH system provided herein can be applied to other tactical systems, not only for the systems and methods described above.

In general, in the following claims, the terms used should not be construed to limit the TDH and TDH system to the specific embodiments disclosed in the specification and the claims, but should be construed to include all tactical systems that operate under the claims. Accordingly, the TDH and TDH system are not limited by the disclosure, but instead the scope of the TDH and TDH system is to be determined entirely by the claims.

While certain aspects of the TDH and TDH system are presented below in certain claim forms, the inventor contemplates the various aspects of the TDH and TDH system in any number of claim forms. Accordingly, the inventor reserves the right to add additional claims after filing the application to pursue such additional claim forms for other aspects of the TDH and TDH system.

What is claimed is:

1. A system comprising:

a tactical component; and a holster coupled to the tactical component, the holster including a plurality of lateral supports coupled to a vertical member, the lateral supports receiving and supporting a housing of a hand-held non-lethal/lethal deployable device (HNLDD), the holster including a platform coupled to a lower region of the vertical member and supporting a base of the housing, and the holster including an indexing device coupled to the platform, wherein the indexing device includes a vertical support having a cavity with an open side receiving and securing a fuze lever of the HNLDD and indexing the HNLDD in a pre-specified position.

2. The system of claim 1, wherein the tactical component includes at least one component selected from a group consisting of tactical personnel duty gear, tactical clothing, vests, vest systems, at least one other holster, holster systems, thigh rigs, harnesses, pouches, equipment, assault systems, and vehicles.

3. The system of claim 1, wherein the tactical component includes a thigh rig and at least one other holster coupled to the thigh rig.

4. The system of claim 1, further comprising a lanyard, wherein the lanyard is coupled between the tactical component and a fuze pin of the HNLDD.

5. The system of claim 1, further comprising a cover, wherein the cover is coupled to one of the tactical component and the holster, the cover positioned to cover at least one portion of the HNLDD.

6. The system of claim 1, further comprising at least one mounting component coupled to the tactical component and the holster, the mounting component including at least one of screws, screws and posts, rivets, eyelets, locking and removeable utility belt clips, snaps, rails, clips, straps, and Velcro.

7. The system of claim 1, wherein the holster further comprises a restricter coupled to an upper region of the vertical member, the restricter securing the fuze lever.

8. The system of claim 1, wherein the lateral support members are semicircular to receive and support a cylindrical housing.

* * * * *